US011152199B2

(12) United States Patent
Roberts et al.

(10) Patent No.: US 11,152,199 B2
(45) Date of Patent: Oct. 19, 2021

(54) MULTIPOLE ION OPTIC ASSEMBLY

(71) Applicant: Agilent Technologies, Inc., Santa Clara, CA (US)

(72) Inventors: Robert M. Roberts, Onancock, VA (US); James L. Bertsch, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 132 days.

(21) Appl. No.: 16/717,791

(22) Filed: Dec. 17, 2019

(65) Prior Publication Data

US 2020/0211832 A1 Jul. 2, 2020

Related U.S. Application Data

(60) Provisional application No. 62/787,108, filed on Dec. 31, 2018.

(51) Int. Cl.

| | |
|---|---|
| ***H01J 49/00*** | (2006.01) |
| ***H01J 49/06*** | (2006.01) |
| ***H01J 49/26*** | (2006.01) |
| *H01J 49/10* | (2006.01) |

(52) U.S. Cl.
CPC ..... *H01J 49/063* (2013.01); *H01J 49/26* (2013.01); *H01J 49/10* (2013.01)

(58) Field of Classification Search
CPC ..... H01J 49/063; H01J 49/26; H01J 49/10; H01J 49/068
USPC ..... 250/281, 282, 290, 293, 296, 297
See application file for complete search history.

(56) References Cited

U.S. PATENT DOCUMENTS

| | | | | |
|---|---|---|---|---|
| 6,417,511 | B1 * | 7/2002 | Russ, IV | H01J 49/063 250/292 |
| 6,617,578 | B1 * | 9/2003 | Tong | H01J 49/063 250/292 |
| 7,064,322 | B2 * | 6/2006 | Crawford | H01J 49/063 250/282 |
| 8,193,489 | B2 * | 6/2012 | Bertsch | H01J 49/421 250/292 |
| 9,449,804 | B2 | 9/2016 | Bertsch et al. | |
| 2013/0015341 | A1 * | 1/2013 | Steiner | H01J 49/4255 250/281 |

* cited by examiner

*Primary Examiner* — Michael Maskell

(57) ABSTRACT

An ion optic assembly includes a set of conductive rods, a first insulator, and a second insulator. The rods are inserted into through-holes of the first insulator, which are arranged about an axis along which the rods are elongated. The rods are then inserted through a bore of the second insulator and become located in notches of the bore, which are arranged about the axis. Accordingly, the first insulator positions one end of the rods at a first distance from the axis, and the second insulator positions the other end of the rods at a second distance from the axis, which may equal to or different from the first distance. The rods contact, and may be spring-biased against, the notches. The assembly may include an electrical contact with fingers spring-biased into contact with the rods. Each insulator may include both through-holes and notches for additional rods.

20 Claims, 11 Drawing Sheets

MULTIPOLE ION OPTIC ASSEMBLY

RELATED APPLICATIONS

This application claims the benefit under 35 U.S.C. § 119(e) of U.S. Provisional Patent Application Ser. No. 62/787,108, filed Dec. 31, 2018, titled "MULTIPOLE ION OPTIC ASSEMBLY," the content of which is incorporated by reference herein in its entirety.

TECHNICAL FIELD

The present invention relates to ion optic assemblies, particularly linear (two-dimensional) multipole rod assemblies, as may be utilized in mass spectrometry systems to guide or transport ions.

BACKGROUND

A mass spectrometry (MS) system in general includes an ion source for ionizing molecules of a sample of interest, followed by one or more ion processing devices providing various functions, followed by a mass analyzer for separating ions based on their differing mass-to-charge ratios (or m/z ratios, or more simply "masses"), followed by an ion detector at which the mass-sorted ions arrive. An MS analysis produces a mass spectrum, which is a series of peaks indicative of the relative abundances of detected ions as a function of their m/z ratios.

One example of an ion processing device that may be positioned in the process flow between the ion source and the mass analyzer is an ion optic assembly having a multipole rod configuration. The ion optic assembly may be positioned near the ion source, where the ion optic assembly may transport ions through one or more pressure-reducing stages that successively lower the gas pressure down to the very low operating pressure (high vacuum) of the analyzer portion of the system. An ion optic assembly may also be positioned in a collision cell that receives ions and produces fragment ions from the received ions.

Prior art to making ion optic assemblies that have multiple sets of rods (or poles) typically involves precisely positioning numerous conductive rods to be either parallel to one another or at some constant angle relative to one another, or combination of the two, so that when energized by an applied RF/DC voltage that a composite RF/DC electric field is created along their axis that then typically creates an enclosed volume or tunnel with known electrical fields that can then control/contain/carry along ions (molecules that have a positive or negative charge) traveling through the field tunnel's overall axis. The typical number of rods used on each set of the rods is four, six, or eight. The traditional method of holding the multiple sets of rods in their desired orientation is using a mechanical fixture that is then followed by one of the following conductive fastening processes: soldering, applying conductive epoxy, laser welding, spot welding, etc. Disadvantages from an assembly standpoint is that it is very time consuming to load the fixtures with the required parts, and verify that the precise alignment has been achieved between all the mating parts followed by the need of a highly skilled operator to work, typically underneath a microscope, to apply the solder and reflow the solder to the multiple joints. After the soldering, the assembly must be chemically cleaned. Moreover, typically, one has to apply conductive epoxy to multiple joints and then cure the assembly in a dedicated oven which can take multiple hours to complete the cure. One alternative to this adhesive/curing assembly process is using a micro laser to weld or spot weld, but this alternative requires very expensive equipment with additional tooling and custom programming.

In view of the foregoing, there is a need for improved (e.g., simplified) methods for assembling ion optic assemblies.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, an ion optic assembly includes: a plurality of electrically conductive rods elongated along a device axis, the rods comprising respective first rod ends and axially opposing second rod ends, wherein the rods are spaced from each other in a transverse plane orthogonal to the device axis; a first insulator comprising a plurality of through-holes, the through-holes spaced from each other about the device axis; and a second insulator comprising a bore wall defining a bore coaxial with the device axis, the bore wall comprising a plurality of notches spaced from each other about the device axis, wherein: the rods respectively extend through the through-holes at the first rod ends; and the rods extend through the bore at the second rod ends in respective contact with the notches.

According to another embodiment, an ion optic assembly includes: a plurality of electrically conductive first rods elongated along a device axis, the first rods comprising respective first rod ends and axially opposing second rod ends, wherein the first rods are spaced from each other in a transverse plane orthogonal to the device axis; a plurality of electrically conductive second rods elongated along the device axis, the second rods comprising respective third rod ends and axially opposing fourth rod ends, wherein the second rods are spaced from each other in the transverse plane; a first insulator comprising a plurality of first through-holes, the first through-holes spaced from each other about the device axis, and a first bore wall defining a first bore coaxial with the device axis and comprising a plurality of first notches spaced from each other about the device axis; and a second insulator comprising a plurality of second through-holes, the second through-holes spaced from each other about the device axis, and a second bore wall defining a second bore coaxial with the device axis, the second bore wall comprising a plurality of second notches spaced from each other about the device axis, wherein: the first rods respectively extend through the first through-holes at the first rod ends; the first rods extend through the second bore at the second rod ends in respective contact with the second notches; the second rods respectively extend through the second through-holes at the third rod ends; and the second rods respectively extend through the second through-holes at the third rod ends; and the second rods extend through the first bore at the fourth rod ends in respective contact with the first notches.

According to another embodiment, a method for assembling an ion optic assembly includes: providing a first insulator positioned on a device axis and comprising a plurality of through-holes, wherein the through-holes are spaced from each other in a transverse plane orthogonal to the device axis; providing a plurality of electrically conductive rods comprising respective first rod ends and axially opposing second rod ends; inserting the first rod ends into the respective through-holes, such that the rods are elongated along the device axis; positioning a second insulator to face the first insulator along the device axis, the second insulator comprising a bore wall defining a bore coaxial with the device axis, the bore wall comprising a plurality of notches spaced from each other about the device axis; and inserting the second rod ends into the bore such that the second rod ends respectively contact the notches.

According to another embodiment, a method for assembling an ion optic assembly includes: providing a first insulator comprising a plurality of first through-holes, the first through-holes spaced from each other about a device axis, and a first bore wall defining a first bore coaxial with the device axis and comprising a plurality of first notches spaced from each other about the device axis; providing a second insulator comprising a plurality of second through-holes, the second through-holes spaced from each other about the device axis, and a second bore wall defining a second bore coaxial with the device axis, the second bore wall comprising a plurality of second notches spaced from each other about the device axis; providing a plurality of electrically conductive first rods comprising respective first rod ends and axially opposing second rod ends; providing a plurality of electrically conductive second rods comprising respective third rod ends and axially opposing fourth rod ends; inserting the first rods into the respective first through-holes at the first rod ends; inserting the second rods into the respective second through-holes at the third rod ends; inserting the first rods into the second bore of the second insulator at the second rod ends, such that the first rods contact the respective second notches; and inserting the second rods into the first bore of the first insulator at the fourth rod ends, such that the second rods contact the respective first notches.

According to another embodiment, a spectrometry system, such as a mass spectrometry system or an ion mobility spectrometry system, includes an ion optic assembly according to any of the embodiments disclosed herein. In some embodiments, the ion optic assembly is positioned between an ion source and a mass analyzer or time-of-flight analyzer.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

As will become evident from the following description, embodiments disclosed herein provide an ion optic assembly and a method for assembling an ion optic assembly. Further, the configuration and method may eliminate the need for the following traditional conductive fastening processes: soldering process followed by chemical cleaning, conductive epoxy process followed by an elevated temperature cure cycle, laser welding process, spot welding process, etc.

Figure 1:
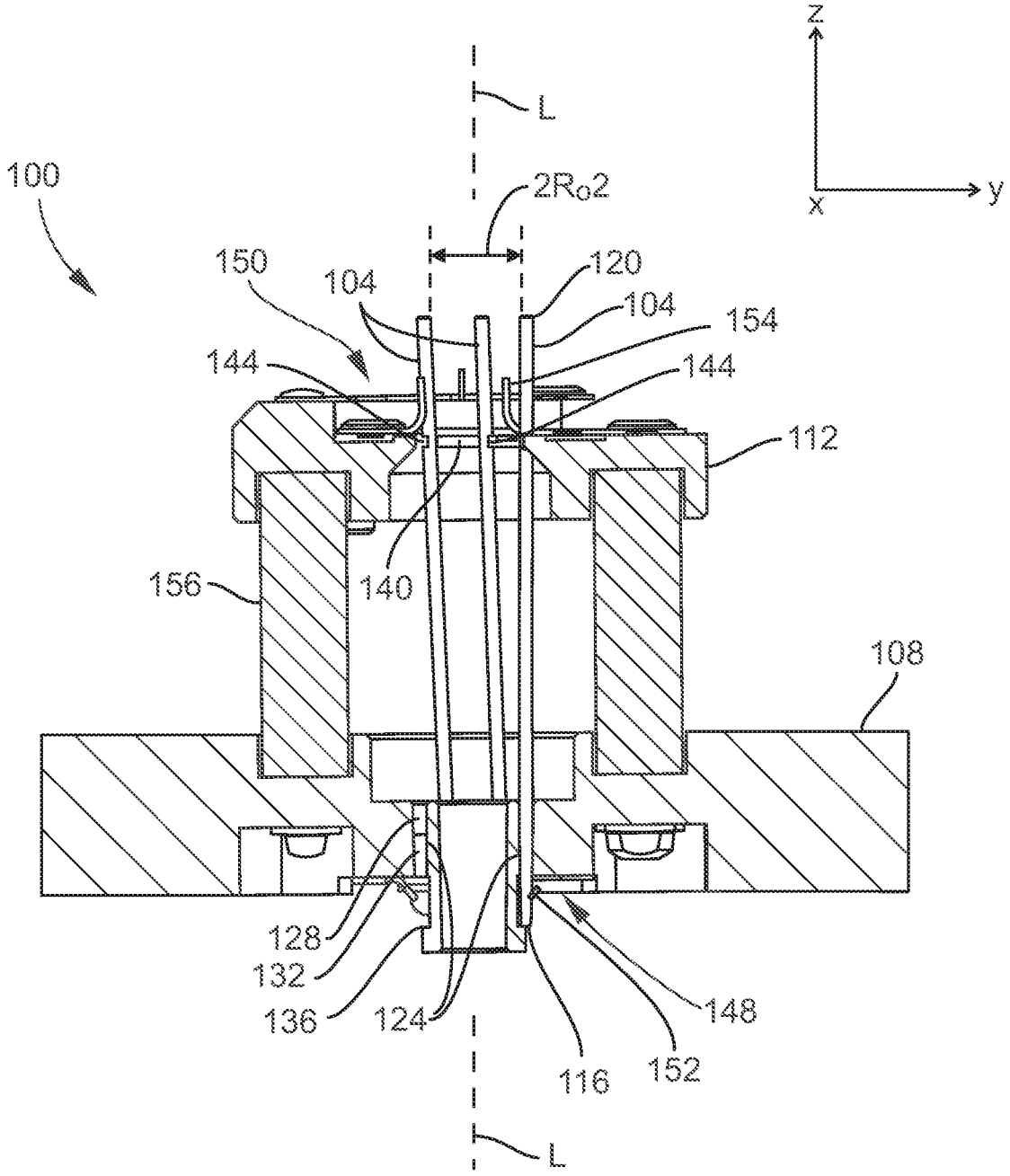
FIG. 1 is a cross-sectional view of an example of an ion optic assembly according to an embodiment of the present disclosure.

FIG. 1 is a cross-sectional view of ion optic assembly 100 according to an embodiment. For reference purposes, the ion optic assembly 100 may be considered as being arranged along a device axis L (or longitudinal axis, or ion optic axis). Also, for reference purposes, FIG. 1 includes an arbitrarily positioned Cartesian (x-y-z) frame of reference. In this example, the device axis L corresponds to the z-axis, and the transverse plane orthogonal to the device axis L corresponds to the x-y plane. In the context of the present disclosure, the term "axial" relates to the device axis L or a direction generally parallel to the device axis L.

The ion optic assembly 100 has a linear (two-dimensional) multipole configuration. Accordingly, the ion optic assembly 100 includes a plurality of electrically conductive (first) rods (or poles) 104 (i.e., a (first) rod set), a first insulator 108, and a second insulator 112.

The rods 104 are elongated along the device axis L, generally running between the first insulator 108 and the second insulator 112. Each rod 104 extends longitudinally and includes a first rod end 116 and a second rod end 120 axially opposite the first rod end 116. The rods 104 are spaced from each other in the transverse plane. For example, in embodiments where the rods 104 are arranged in a circular pattern in the transverse plane (such as illustrated), the rods 104 are circumferentially (in an angular or arcuate direction about the device axis L) spaced from each other in the transverse plane. Moreover, the rods 104 may be equally spaced from each other in the transverse plane. In such embodiments, the rods 104 are coaxially arranged about the device axis L, each at a radius $R_0$ relative to the device axis L. Typically, there are an even number of rods 104, with pairs of rods 104 being diametrically opposite to each other (180 degrees apart) relative to the device axis L. Accordingly, opposing pairs of rods 104 are spaced from each other at a diameter of $2R_0$. Typically, the number of rods 104 provided in a given rod set is four (a quadrupole arrangement), six (a hexapole arrangement), or eight (an octopole arrangement), although a greater (and typically even) number of rods 104 may be provided. In the present embodiment, the ion optic assembly 100 includes six rods 104, only three of which are shown in FIG. 1.

In some embodiments, the rods 104 are parallel with the device axis L, such that the radius $R_0$ is constant along the device axis L between the first insulator 108 and the second insulator 112. In other embodiments and as illustrated, the rods 104 are oriented at an angle to the device axis L, such that the radius $R_0$ varies along the device axis L between the first insulator 108 and the second insulator 112. That is, the rods 104 may converge toward each other or diverge away from each other in a given direction along the device axis L. The angle of convergence or divergence may be constant along the device axis L, although a constant convergence or divergence is not required. Whether the rods 104 are parallel or at an angle to the device axis L, the rods 104 may be either straight or bowed after assembly of the ion optic assembly 100.

Typically, in a given rod set, at any position of the transverse plane along the device axis L (i.e., at any elevation in FIG. 1), the spacing (e.g., the diameter of $2R_0$) between opposing pairs of rods 104 are equal for all opposing pairs of rods 104, such that the rods 104 inscribe or approximate a circle or a regular polygon in the transverse plane. In an alternative embodiment, the spacing between one or more opposing pairs of rods 104 may be different or offset from one or more other opposing pairs of rods 104, such that the rods 104 inscribe or approximate a different shape such as an oval (or ellipse) or polygon. Hence, from the perspective of the transverse plane, the rods 104 may be arranged about the device axis L in a circular pattern, an elliptical pattern, or a polygonal pattern. In some embodiments, the spacing between one or more pairs of adjacent rods 104 in the transverse plane may be different from the spacing between one or more other pairs of adjacent rods 104 in the transverse plane, such that the rods 104 inscribe or approximate a rectangle or other polygonal shape. In general, the spacing between the pairs of opposing rods 104 form the above-noted volume or tunnel with electrical fields that can then control/contain/carry along ions traveling through the field tunnel's overall axis.

In an embodiment, an oval entrance may be useful to take advantage of the asymmetrical phase space of ions exiting a quadrupole mass filter that precedes the ion optic assembly 100. In an embodiment, an oval exit may be useful to take advantage of the asymmetrical entrance acceptance of a quadrupole that follows the ion optic assembly 100. In an embodiment, an oval exit may also be useful in a system that includes a time-of-flight (TOF) analyzer, to improve transmission through the ion beam slicer that is often provided at the entrance to the TOF analyzer.

In a typical embodiment, the rods 104 are cylindrical, with circular cross-sections in the transverse plane. In other embodiments, the cross-sections of the rods 104 may be polygonal (e.g., rectilinear)—for example, the rods 104 may be shaped as bars or plates. The rods 104 may be composed of any conductive material suitable for use in generating the RF or composite RF/DC fields contemplated for their operation in an ion processing instrument. In some embodiments, the rods 104 may include a core surrounded by one or more layers. In such embodiments, the rods 104 may include resistive and/or insulating material in addition to conductive material. Examples of such composite rods are described in, for example, U.S. Pat. Nos. 7,064,322 and 9,449,804, the entire contents of which are incorporated by reference herein.

Figure 2:
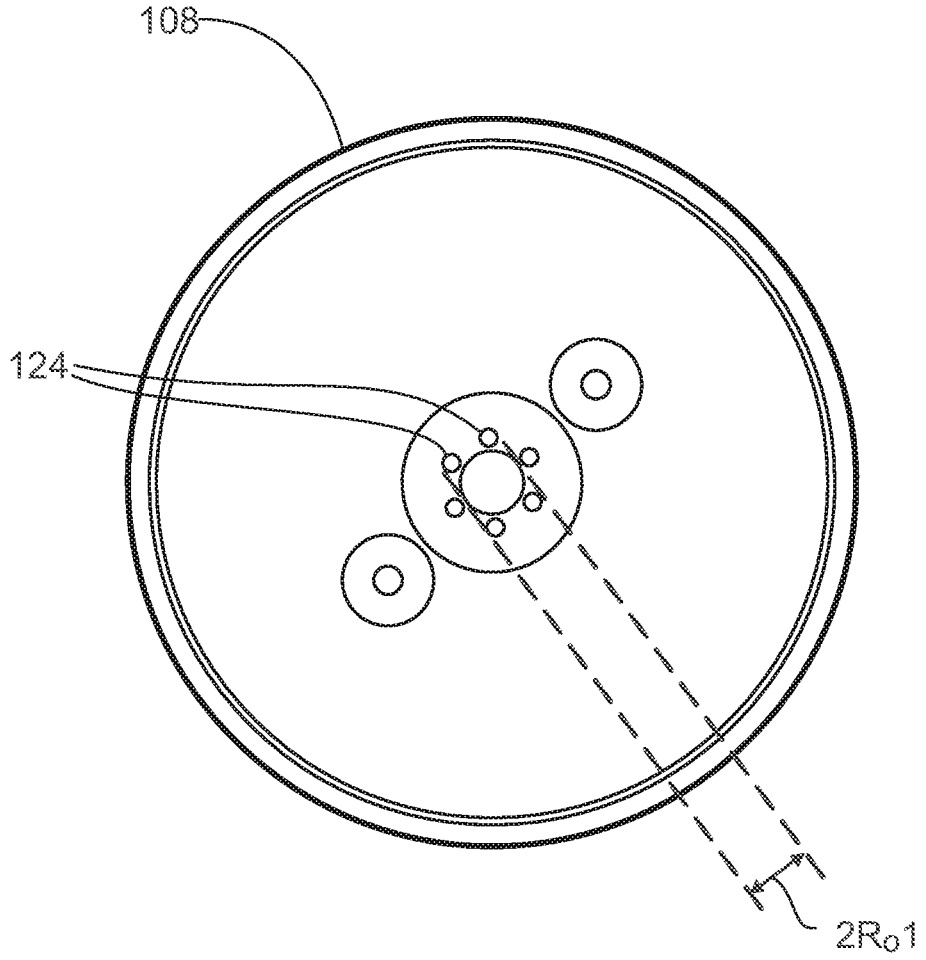
FIG. 2 is a perspective view of a first insulator of the ion optic assembly illustrated in FIG. 1.

The first insulator 108 includes a plurality of through-holes 124. The number of through-holes 124 corresponds to the number of rods 104, which is six in the present non-exclusive example. The arrangement or pattern of the through-holes 124 is more clearly shown in FIG. 2. FIG. 2 is a perspective view of the first insulator 108, illustrating the inside surface of the first insulator 108 that faces the inside surface of the second insulator 112 along the device axis L. The through-holes 124 extend through the axial thickness of the first insulator 108 from the inside surface of the first insulator 108 to the outside surface of the first insulator 108 (the side of the first insulator 108 facing away from the second insulator 112). The through-holes 124 are spaced from each other about the device axis L. For example, the through-holes 124 may be circumferentially (in an angular or arcuate direction about the device axis L) spaced from each other in a circular pattern (as illustrated), such that the through-holes 124 are positioned in the transverse plane at a first radius $R_0$1 from the device axis L. Accordingly, opposing pairs of through-holes 124 are spaced from each other by a diameter of $2R_0$1, as shown in FIG. 2. It will be noted that in the context of the present disclosure, radii $R_0$ are measured/defined from the device axis L to the inside point on the through-hole 124 (or rod 104) closest to the device axis L.

In assembling the ion optic assembly 100, the first rod ends 116 of the rods 104 are inserted into (and typically through) the through-holes 124. Thus, the through-holes 124 determine the radial position (the first radius $R_0$1) of the rods 104 at the first rod ends 116.

Referring to FIG. 1, in an embodiment, the through-holes 124 each include a slip-fit section 128 and an adjoining press-fit section 132. The slip-fit section 128 begins at an opening at the inside (interior) surface of the first insulator 108 and transitions to the press-fit section 132, which leads to an opening at the outside (exterior) surface of the first insulator 108. The slip-fit section 128 has a slip-fit diameter (typically slightly) larger than the outside diameter of the rods 104, and the press-fit section 132 has a press-fit diameter only slightly smaller than the outside diameter of the rods 104. By this configuration, during assembly, the slip-fit sections 128 facilitate the locating or the guiding of the rods 104 into the corresponding through-holes 124. Moreover, the press-fit sections 132 facilitate securing the rods 104 in a fixed axial position by press-fit or interference fit, once the rods 104 have reached their correct axial position after being inserted through the through-holes 124.

As also shown in FIG. 1, the first insulator 108 may include an annular shoulder 136 (or a circumferential arrangement of shoulders 136) coaxial with the device axis L. The shoulder 136 serves as a mechanical stop against which the first rod ends 116 abut, thereby determining the final, correct axial position of the rods 104 after the rods 104 have been inserted through the through-holes 124.

The second insulator 112 includes a bore wall 140 defining a bore coaxial with the device axis L. The bore extends through the axial thickness of the second insulator 112 from the inside surface of the second insulator 112 to the outside surface of the second insulator 112 (the side of the second insulator 112 facing away from the first insulator 108). The bore wall 140 includes a plurality of notches (or recesses)

144 spaced from each other about the device axis L and which are open to the bore. For example, the notches 144 may be circumferentially spaced from each other in a circular pattern about the device axis L (as illustrated). The number of notches 144 corresponds to the number of rods 104, which again is six in the present non-exclusive example. The shape or profile of the notches 144 is configured as needed to receive the rods 104. For example, the shape of the notches 144 generally may be curved or concave. In a non-exclusive example, the shape of the notches 144 may be circular or otherwise complementary to the shape of the outer surface of the rods 104. The configuration of the bore wall 140 and notches 144 may be similar to the configuration of the bore wall 540 and notches 544 described before and illustrated in FIGS. 5B and 5C.

During assembly, the second insulator 112 is located on the device axis L such that the second rod ends 120 pass through the bore and are positioned into the respective notches 144. The notches 144 are positioned at a certain radial distance from the device axis L (which may be referred to as a notch radius) such that, after the rods 104 are positioned in contact with the notches 144, the rods 104 are positioned in the transverse plane at a second radius $R_0$2 from the device axis L. As an example, FIG. 1 illustrates the diameter between an opposing pair of rods 104 as being $2R_0$2 at the notches 144. Thus, the notches 144 determine the radial position (the second radius $R_0$2) of the rods 104 at the second rod ends 120.

In embodiments where the rods 104 are to be parallel or substantially parallel, the first radius $R_0$1 (or diameter $2R_0$1) is equal (or substantially equal, e.g. +/−10%) to the second radius $R_0$2 (or diameter $2R_0$2). In other embodiments, the first radius $R_0$1 (or diameter $2R_0$1) and the second radius $R_0$2 (or diameter $2R_0$2) may be different. For example, the second radius $R_0$2 may be smaller than the first radius $R_0$1, in which case after assembly the rods 104 converge in the direction from the first insulator 108 to the second insulator 112. Conversely, the second radius $R_0$2 may be larger than the first radius $R_0$1, in which case after assembly the rods 104 diverge in the direction from the first insulator 108 to the second insulator 112 as illustrated.

The first insulator 108 and the second insulator 112 may have generally plate-like or disk-like geometries oriented in the transverse plane. However, as illustrated and as will be appreciated by persons skilled in the art, the first insulator 108 and the second insulator 112 typically include several engineered features as needed for mounting or accommodating various components of the ion optic assembly 100. The first insulator 108 and the second insulator 112 may be composed of any suitable electrically insulating material. Examples of suitable electrically insulating materials include various non-conductive polymers, one specific yet non-exclusive example being polyether ether ketone (PEEK) or other members of the polyaryletherketone (PAEK) family.

As further illustrated in FIG. 1, the ion optic assembly 100 may include an electrical contact assembly 148 mounted to the outside surface of the first insulator 108. The electrical contact assembly 148 may include a plurality of electrically conductive (first) fingers 152 arranged (e.g., circumferentially) about the device axis L. The number of fingers 152 corresponds to the number of rods 104, which again is six in the present non-exclusive example. The fingers 152 are configured to be deflectable, and are sized and positioned such that the diameter between opposing pairs of fingers 152 is slightly smaller than the diameter (e.g., $2R_0$1) between the opposing pairs of rods 104 at the first rod ends 116. By this configuration, when the rods 104 are inserted through the through-holes 124, the fingers 152 are spring-biased radially inward into contact with the respective rods 104 at the first rod ends 116. This configuration of the contact assembly 148 with the spring fingers 152 is advantageous in that it creates electrical connections without the need for conventional means such as the use of solder, conductive epoxy, etc. The configuration of the contact assembly 148 may be similar to the configuration of the contact assembly 448 described below and illustrated in FIGS. 4B and 4C.

The contact assembly 148 may be configured to apply the same RF or RF/DC potentials to all of the rods 104 via the fingers 152. In other embodiments, the contact assembly 148 may be configured to apply different potentials to different rods 104 or groups of rods 104. For example, in some applications, it is desirable to apply different polarities to adjacent rods 104. In the present example of six rods 104, the RF potential applied to the first, third, and fifth rods 104 may be 180 degrees out of phase with the RF potential applied to the second, fourth, and sixth rods 104. More generally, in one embodiment, the plurality of fingers 152 may include a first group of fingers 152 spring-biased in contact with a first group of the rods 104, and a second group of fingers 152 spring-biased in contact with a second group of the rods 104, such that the first group of the rods 104 and the second group of the rods 104 are addressable by separate voltage sources.

As further illustrated in FIG. 1, the ion optic assembly 100 may include standoffs (or spacers) 156. The standoffs 156 are located between the first insulator 108 and the second insulator 112 to establish their spacing. As part of the assembly, the first insulator 108 and the second insulator 112 may be attached to the opposing axial ends of the standoffs 156 by any suitable fastening means, such as for example screws, bolts, etc. Alternatively, the standoffs 156 in FIG. 1 may represent the cross-section of a single-piece or multi-piece hollow cylindrical structure. When the ion optic assembly 100 is installed in an associated ion processing (e.g., mass spectrometry) instrument, the ion optic assembly 100 may be enclosed by a housing (not shown) configured to maintain a pressure-controlled (e.g., vacuum-level) operating environment.

An example of a method for assembling the ion optic assembly 100 will now be described. The first insulator 108 is placed in a fixed position by any suitable means, thereby defining the device axis L. The rods 104 are then inserted into respective slip-fit sections 128 of the through-holes 124. The rods 104 are then pressed through the press-fit sections 132 of the through-holes 124 by any suitable means until the rods 104 reach a predetermined final axial position. The rods 104 all may be pressed through the press-fit sections 132 simultaneously in a single press operation, for example by a small bench top arbor press operation.

In one embodiment, the final axial position of the rods 104 may be determined by the shoulder 136 described above. In another embodiment, the shoulder 136 may not be provided. Instead, tooling sleeves 306 are utilized to set the insertion depth, as described below in conjunction with FIGS. 3A and 3B.

After the rods 104 have been inserted in the through-holes 124 and the press operation has been completed, the rods 104 extend longitudinally, and are (e.g., circumferentially) spaced around, the device axis L. Moreover, the first rod ends 116 are securely positioned at the first radius $R_0$1 from the device axis L, as dictated by the arrangement of the through-holes 124.

In one embodiment, the contact assembly 148 is then mounted to the outside surface of the first insulator 108, whereby the fingers 152 come into spring-biased contact with the rods 104 as described above. In another embodiment, the contact assembly 148 is mounted to the first insulator 108 prior to inserting the rods 104 through the through-holes 124. In a further embodiment, the through-holes 124 do not include the press-fit sections 132 (i.e., the through-holes 124 are solely slip-fit sections 128), and instead the interference fit between the rods 104 and the fingers 152 is relied on to secure the rods 104 in the through-holes 124.

After mounting the first rod ends 116 to the first insulator 108, the second insulator 112 is positioned to face the first insulator 108 along the device axis L, and the free ends (the second rod ends 120) of the rods 104 are inserted through the bore of the second insulator 112. The rods 104 move into contact with the respective notches 144 of the bore, and thereby achieve their final resting orientations and spacing. In particular, at the bore, the rods 104 are positioned at the second radius $R_0$2 from the device axis L, as dictated by the arrangement of the notches 144.

In an embodiment, after mounting the first rod ends 116 to the first insulator 108, the free ends (the second rod ends 120) of the rods 104 are "pre-sprung" radially outward. That is, the diameter between each diametrically opposing pair of free ends of the rods 104 is greater than the intended final diameter $2R_0$2 of the final assembly. The second insulator 112 is configured to lightly collapse, or gather up, the free ends of the rods 104 as the rods 104 are being inserted through the bore. Consequently, the rods 104 are "self-sprung" into place in the corresponding notches 144, i.e., are spring-biased radially outward into contact with the notches 144. In such case, the rods 104 may be slightly bowed inwardly or outwardly in the final assembly. The "pre-sprung" configuration is advantageous because no additional conductive fastening process is required for the free ends of the rods 104. No solder fumes are to be dealt with, no chemical cleaning process is required, no curing equipment is required, and no long epoxy cure cycles are required in part or whole to make the ion optic assembly 100. Hence, this embodiment may achieve significant cost savings and time savings in the production of multipole ion optic assemblies. Moreover, the bowing of the rods 104 may be advantageous in that it allows axial slipping at the free ends of the rods 104 in response to thermal expansion or contraction.

In an embodiment, the "pre-sprung" configuration may be realized by orienting the axes of the through-holes 124 at a small angle to the device axis L. In this manner, the through-holes 124 diverge slightly outwardly in the direction toward the second insulator 112. Consequently, after installing the rods 104 in the through-holes 124, the rods 104 likewise will diverge slightly outwardly, and the diameter between the free ends of the rods 104 will be greater than the intended final diameter $2R_0$2 of the final assembly. When the second insulator 112 is manually placed over the free ends of the rods 104, the rods 104 are forced to deflect radially inwardly (i.e., collapse) and come to rest in the corresponding notches 114 of the bore of the second insulator 112.

In addition to the first set of rods 104, the ion optic assembly 100 may include a second rod set of electrically conductive second rods (not shown), which again would typically consist of four, six, or eight rods. The second rods may be electrically connected to a second electrical contact assembly 150 mounted to the second insulator 112. In an embodiment, the second rod set may be held in place by a conventional method such as, for example, soldering each end of each second rod to the second electrical contact assembly 150. In another embodiment, the second electrical contact assembly 150 may include a plurality of spring-like, electrically conductive second fingers 154 as described herein. In this case, the ion optic assembly 100 may be configured such that the second rod set is assembled in the same or similar manner as described above with regard to the first rod set of first rods 104, as described further below with reference to FIGS. 4A to 6B.

Figure 3A:
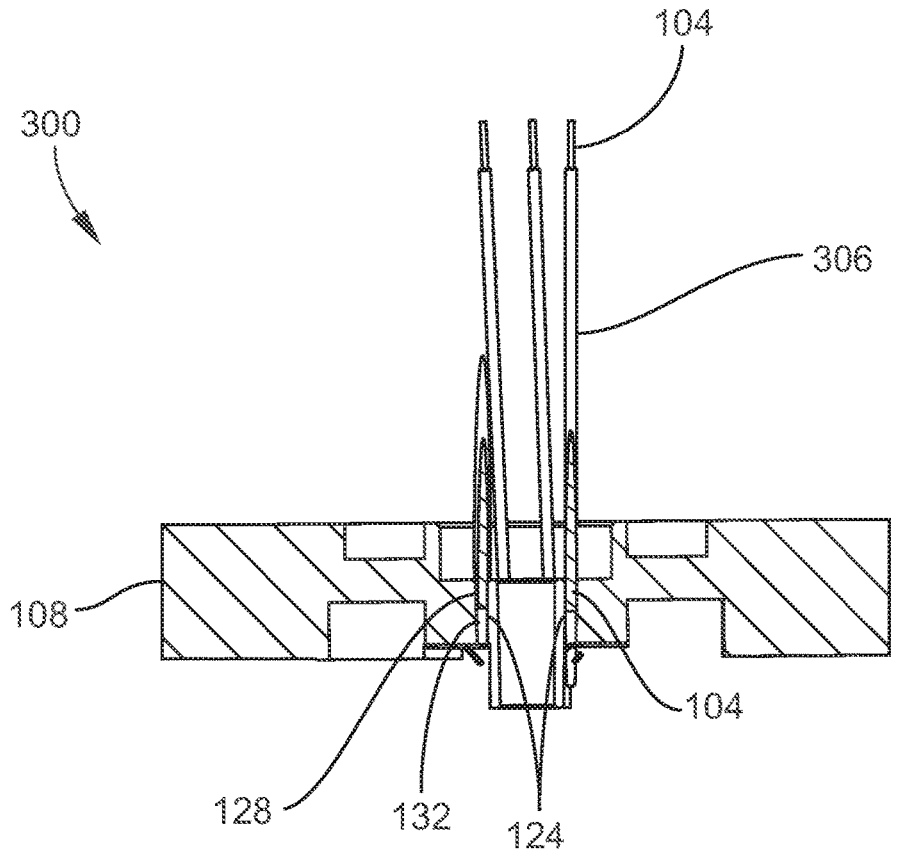
FIG. 3A is a cross-sectional view of an example of an ion optic assembly according to another embodiment, prior to rods being pressed into an insulator of the ion optic assembly.
Figure 3B:
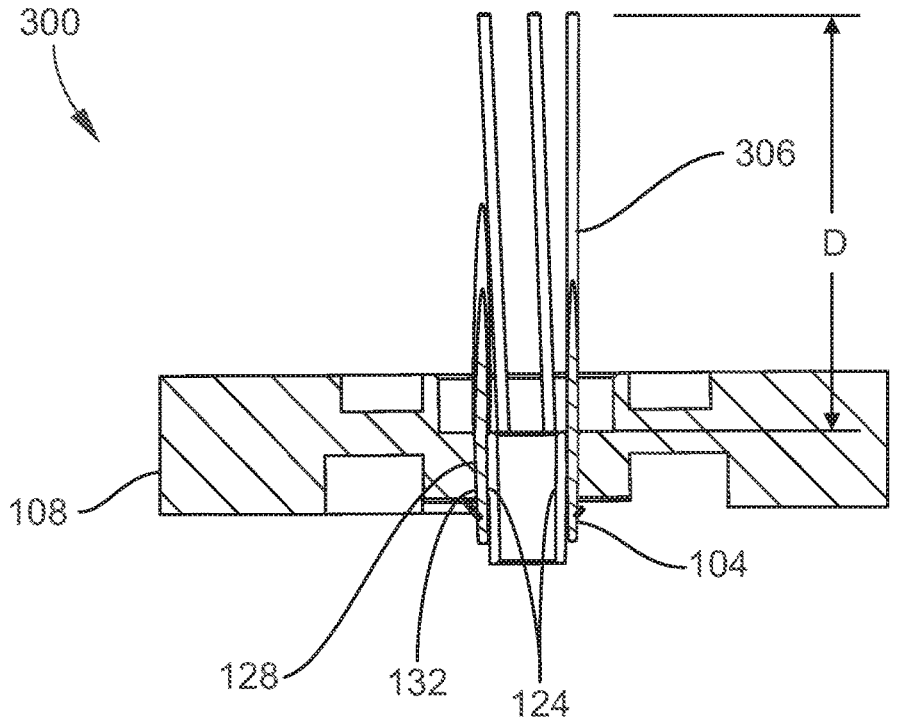
FIG. 3B is a cross-sectional view of an example of the ion optic assembly illustrated in FIG. 3A, after the rods have been pressed into the insulator.

FIGS. 3A and 3B are cross-sectional views of an ion optic assembly 300 according to another embodiment, In this embodiment, the above-described shoulder 136 is not provided. Instead, the insertion depth of the rods 104 through the through-holes 124 of the first insulator 108 is set by tooling sleeves 306. As shown in FIG. 3A, after the rods 104 have been inserted into the slip-fit sections 128 of the through-holes 124, the tooling sleeves 306 are slipped over the respective rods 104. Because the rods 104 have not yet been pushed into the press-fit sections 132, as shown in FIG. 3A, the second rod ends 120 are exposed as the rods 104 extend from the top ends of the tooling sleeves 306. The arbor press (or other pressing apparatus) then is used to push all the rods 104 down through the press-fit sections 132 of the through-holes 124, and the arbor press is forced to stop when it bottoms out on the top ends of the tooling sleeves 306. Hence, the tooling sleeves 306 serve as a hard stop in this embodiment, and keep the rods 104 from buckling during the press-insertion operation. As shown in FIG. 3B, by this configuration, the length of the tooling sleeves 306 determines the final axial position of the rods 104. Once the press operation on the rods 104 has been completed in this manner, the tooling sleeves 306 are then simply slid off the rods 104.

FIGS. 4A to 6B illustrate another embodiment of an ion optic assembly 600 (FIGS. 6A and 6B) configured to assemble two rod sets in a manner similar to the rods 104 described above.

Figure 4A:
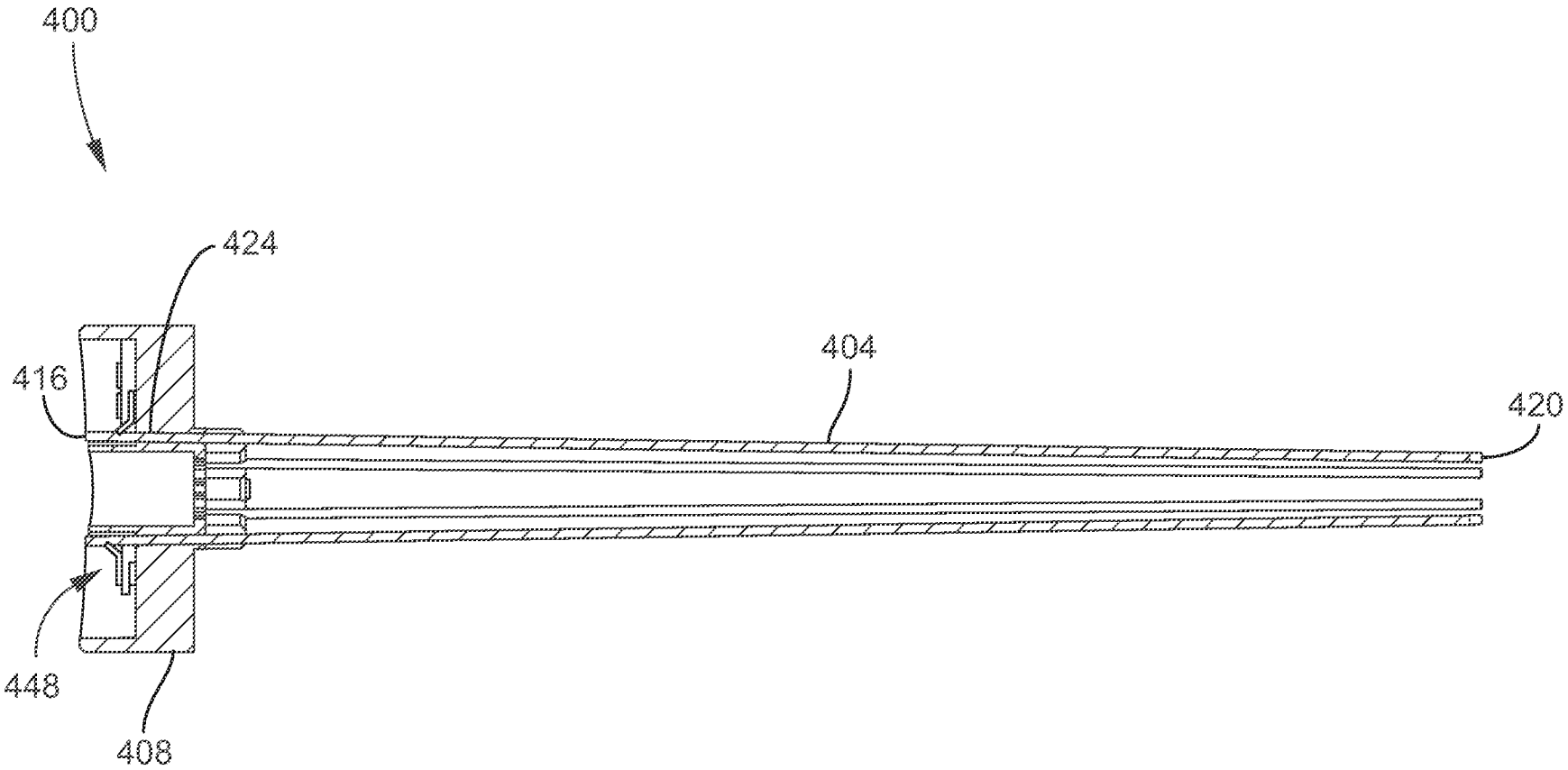
FIG. 4A is a cross-sectional view of an example of a first subassembly of an ion optic assembly according to another embodiment of the present disclosure.
Figure 6A:
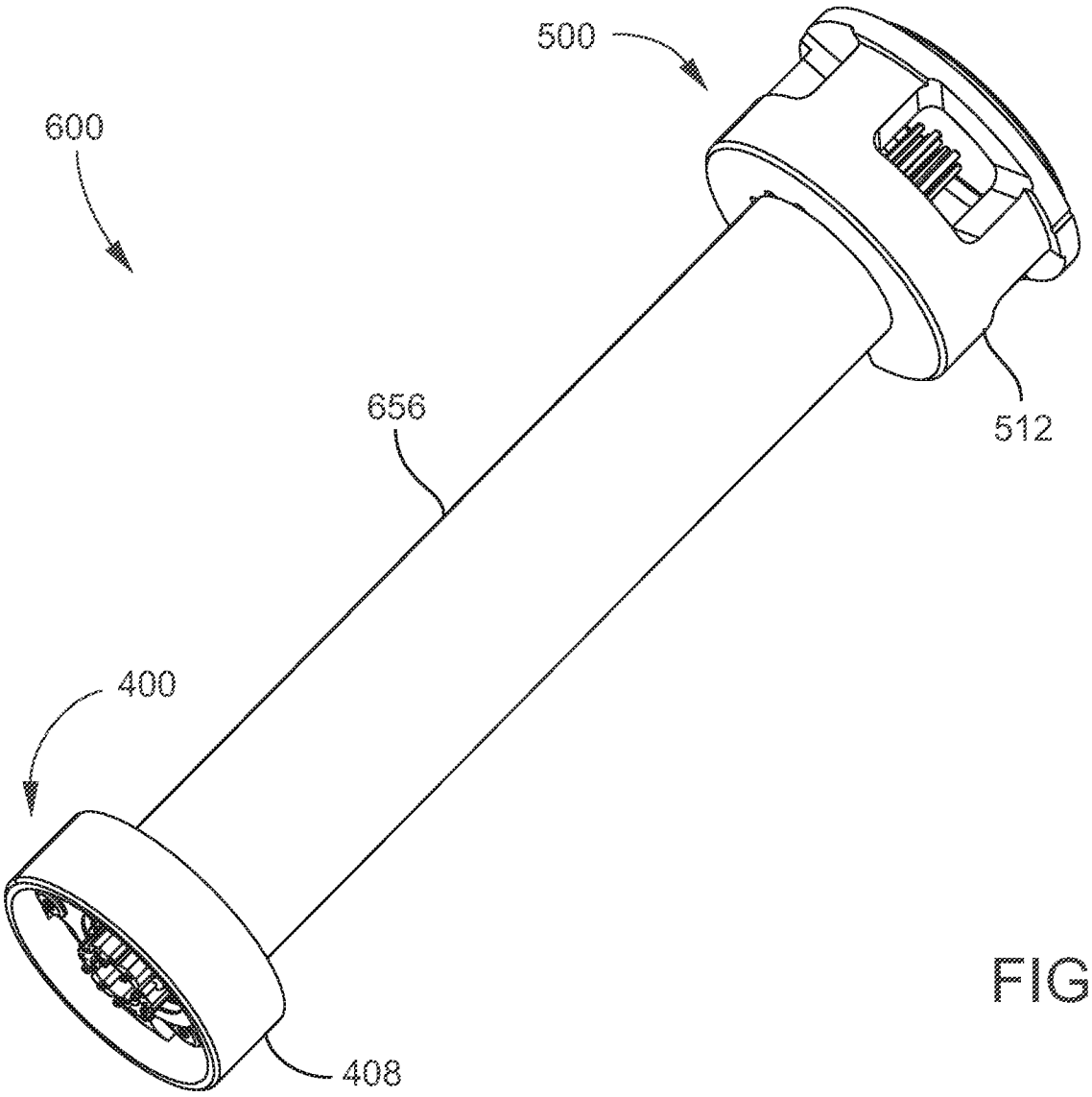
FIG. 6A is a perspective view of an example of an ion optic assembly containing the first subassembly and the second subassembly illustrated in FIGS. 4A to 5C.
Figure 6B:
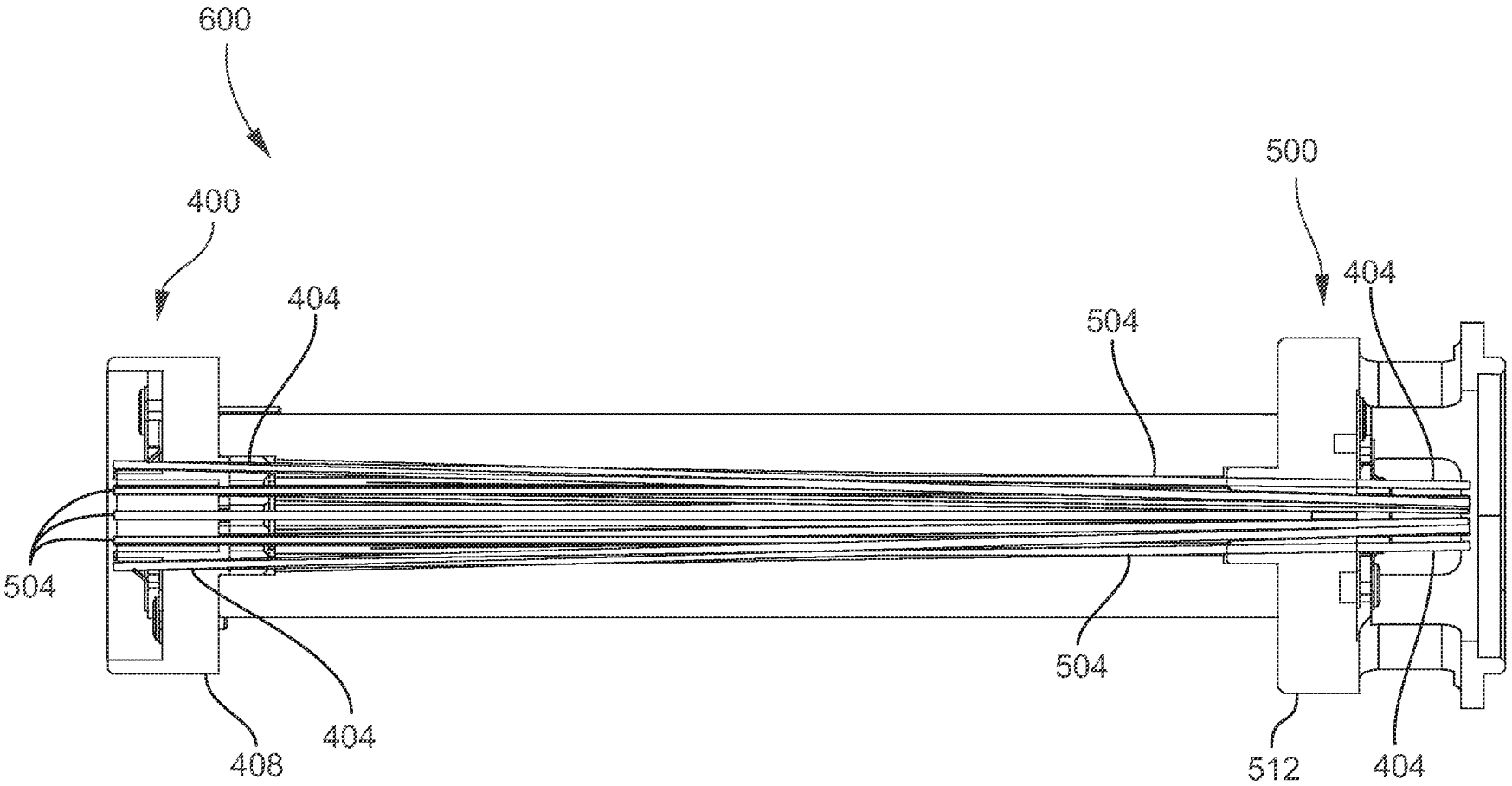
FIG. 6B is a cross-sectional view of the ion optic assembly illustrated in FIG. 6A.

FIG. 4A is a cross-sectional view of a first subassembly 400 of the ion optic assembly 600 (FIGS. 6A and 6B). The first subassembly 400 includes a first rod set (a plurality) of electrically conductive first rods 404 and a first insulator 408. Each first rod 404 is elongated along the device axis between a first rod end 416 and an axially opposing second rod end 420. The first insulator 408 includes a plurality of first through-holes 424 (e.g., circumferentially) spaced from each other about the device axis. The first through-holes 424 may be configured as described above. The first rods 404 may be mounted in the first through-holes 424 in the manner described above. The first through-holes 424 are positioned in the transverse plane at a first radius $R_0$1 from the device axis. The first rods 404 respectively extend through the first through-holes 424 at the first rod ends 416 such that the first rods 404 are positioned at the first radius $R_0$1 at the first through-holes 424. As shown in FIG. 4A, the first rods 404, at this stage of assembly, may extend from the first insulator 408 in a convergent manner. Alternatively, the first rods 404 may extend from the first insulator 408 in a divergent manner.

Figure 4B:
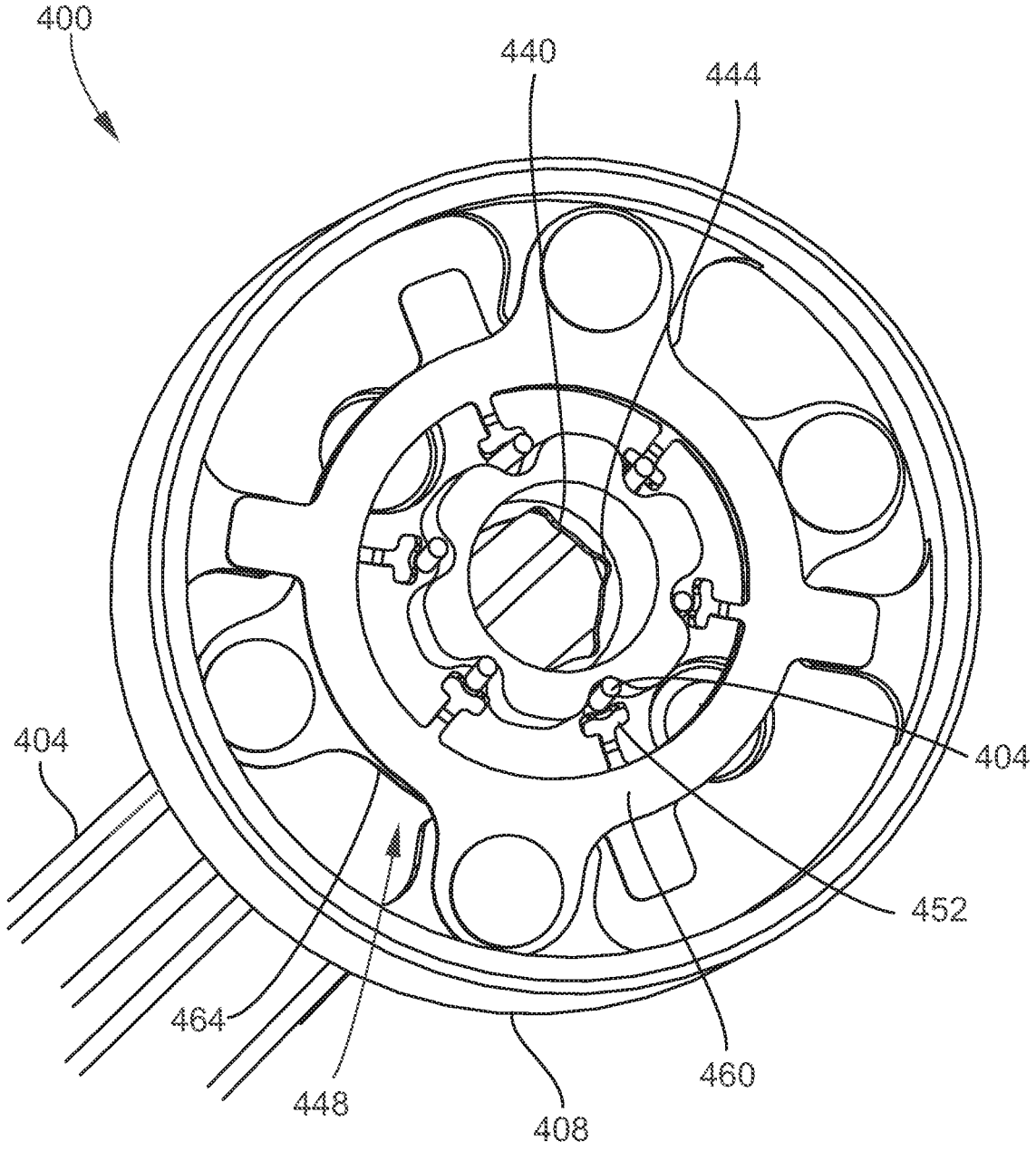
FIG. 4B is a perspective view of the first subassembly illustrated in FIG. 4A, at an end where a first insulator is located.
Figure 4C:
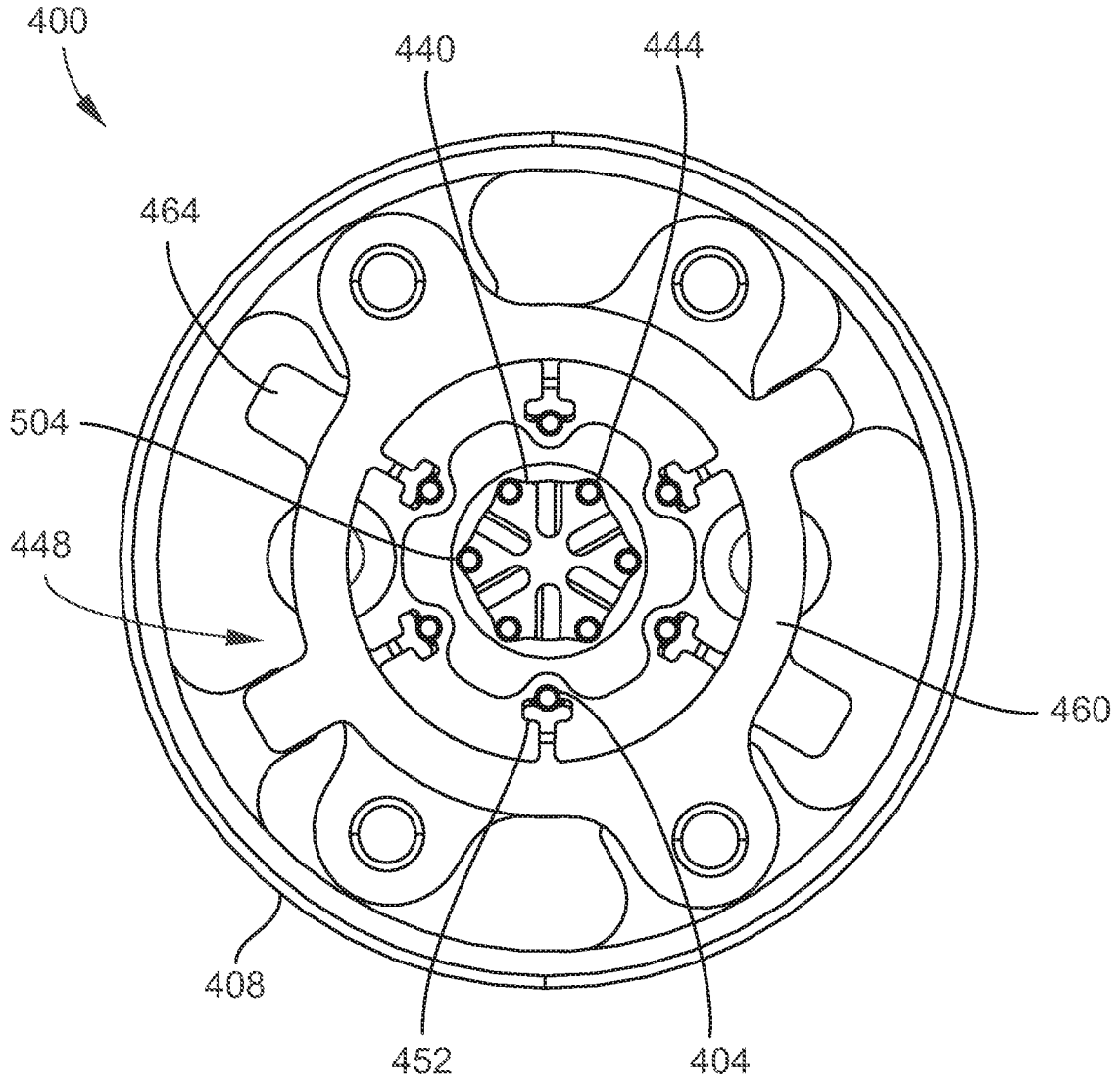
FIG. 4C is a plan view of the first subassembly illustrated in FIG. 4A, at the end where the first insulator is located.

FIG. 4B is a perspective end view of the first subassembly 400. FIG. 4C is a plan end view of the first subassembly 400, and additionally shows second rods 504 of a second subassembly 500 (described below with reference to FIGS. 5A to 5C) installed in the first subassembly 400. In the present embodiment, the first insulator 408 includes a first bore wall 440 defining a first bore coaxial with the device axis. The first bore wall 440 includes a plurality of first notches or recesses 444 (e.g., circumferentially) spaced from each other about the device axis. The configuration of the first bore may be similar to that of the bore of the second insulator 112 of the embodiment described above and illustrated in FIG. 1. As illustrated in FIG. 4C, during assembly, the second rods 504 are gathered or collapsed and come to rest in the respective first notches 444 in the manner described herein. After assembly, the second rods 504 extend through the first bore at the fourth rod ends 520 (FIG. 5A) in respective contact with the first notches 444 such that, at the first notches 444, the second rods 504 are positioned at a fourth radius $R_0$4.

As also shown in FIGS. 4B and 4C, a first electrical contact assembly 448 may be mounted to the outside surface of the first insulator 408. Similar to other embodiments, the first contact assembly 448 includes a plurality of deflectable, electrically conductive first fingers 452 configured to contact the first rods 404 in a spring-biased manner. As illustrated, the first contact assembly 448 may include an electrically conductive first ring 460 from which a first group of the first fingers 452 extend radially inward, and an electrically conductive second ring 464 from which a second group of the first fingers 452 extend radially inward. The first ring 460 and the second ring 464 may be electrically isolated from each other by any suitable means. In the illustrated example, the geometry of the first insulator 408 provides mounting surfaces to space the first ring 460 and the second ring 464 at different axial positions or elevations. This configuration enables different potentials, or potentials with different polarities, to be applied to different first rods 404 as described above, via the respective first ring 460 and second ring 464.

In one embodiment and as shown in FIGS. 4B and 4C, the ends of the first fingers 452 contacting the first rods 404 may be forked. By this configuration, a recess is defined between the two prongs of each first finger 452, and the corresponding first rod 404 is at least partially received in the recess. The forked configuration may be desirable for increasing the area of contact between the first fingers 452 and corresponding first rods 404, thereby increasing electrical contact therebetween.

Figure 5A:
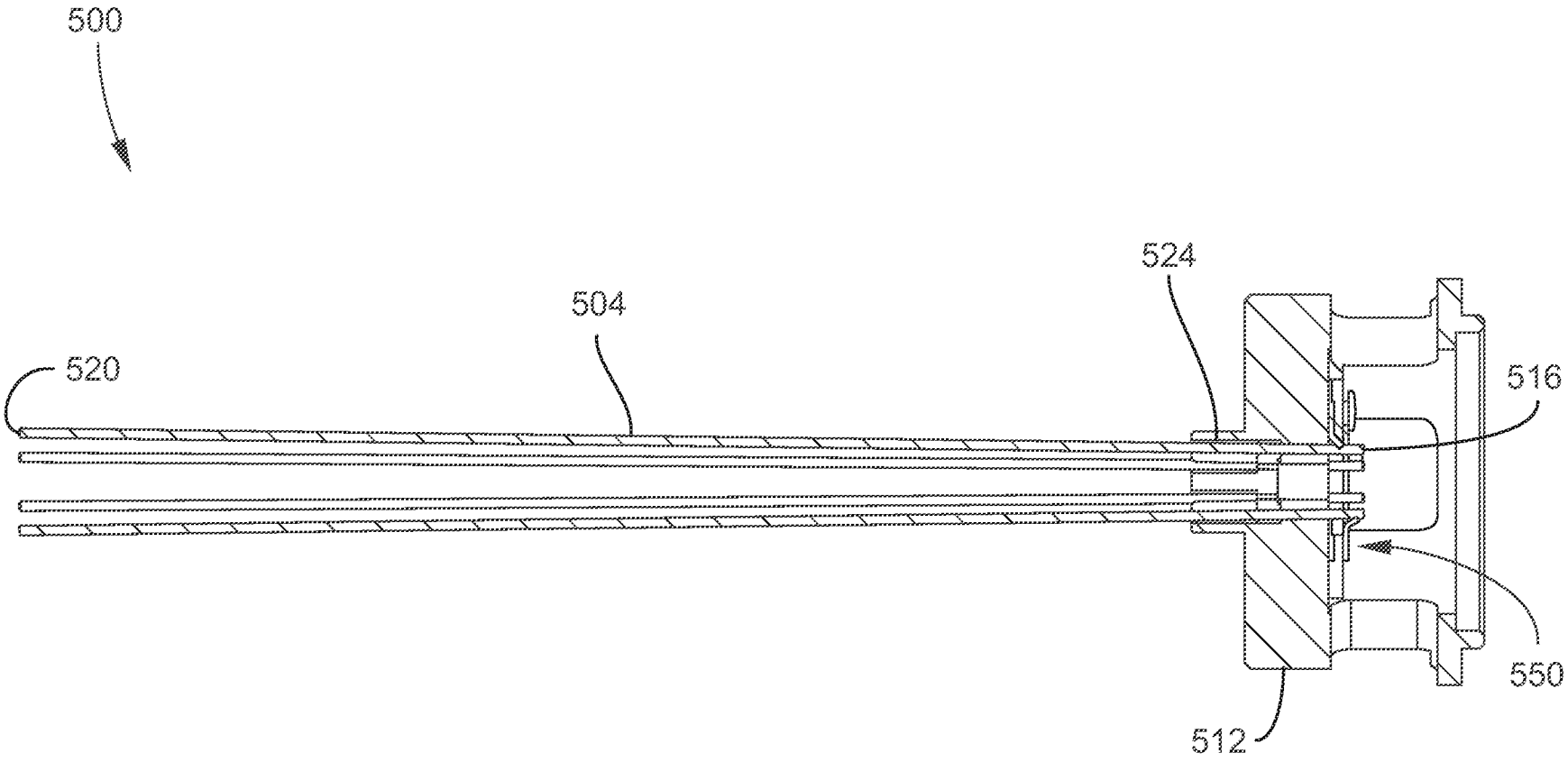
FIG. 5A is a cross-sectional view of an example of a second subassembly of the ion optic assembly associated with the first subassembly illustrated in FIG. 4A.

FIG. 5A is a cross-sectional view of a second subassembly 500 of the ion optic assembly 600 (FIGS. 6A and 6B). The second subassembly 500 includes a second rod set (a plurality) of electrically conductive second rods 504 and a second insulator 512. Each second rod 504 is elongated along the device axis between a third rod end 516 and an axially opposing fourth rod end 520. In this embodiment, the second insulator 512 includes a plurality of second through-holes 524 (e.g., circumferentially) spaced from each other about the device axis. The second through-holes 524 may be similar to first through-holes 424 of the first insulator 408. The third rod ends 516 of the second rods 504 may be inserted through the second through-holes 524 of the second insulator 512 in the manner described above with regard to the first rods 404 and first insulator 408. The second through-holes 524 are positioned in the transverse plane at a third radius $R_0$3 from the device axis. The second rods 504 respectively extend through the second through-holes 524 at the third rod ends 516 such that the second rods 504 are positioned at the third radius $R_0$3 at the second through-holes 524. As shown in FIG. 5A, the second rods 504, at this stage of assembly, extend from the second insulator 413 in a divergent manner. Alternatively, the second rods 504 may extend from the second insulator 413 in a convergent manner.

Figure 5B:
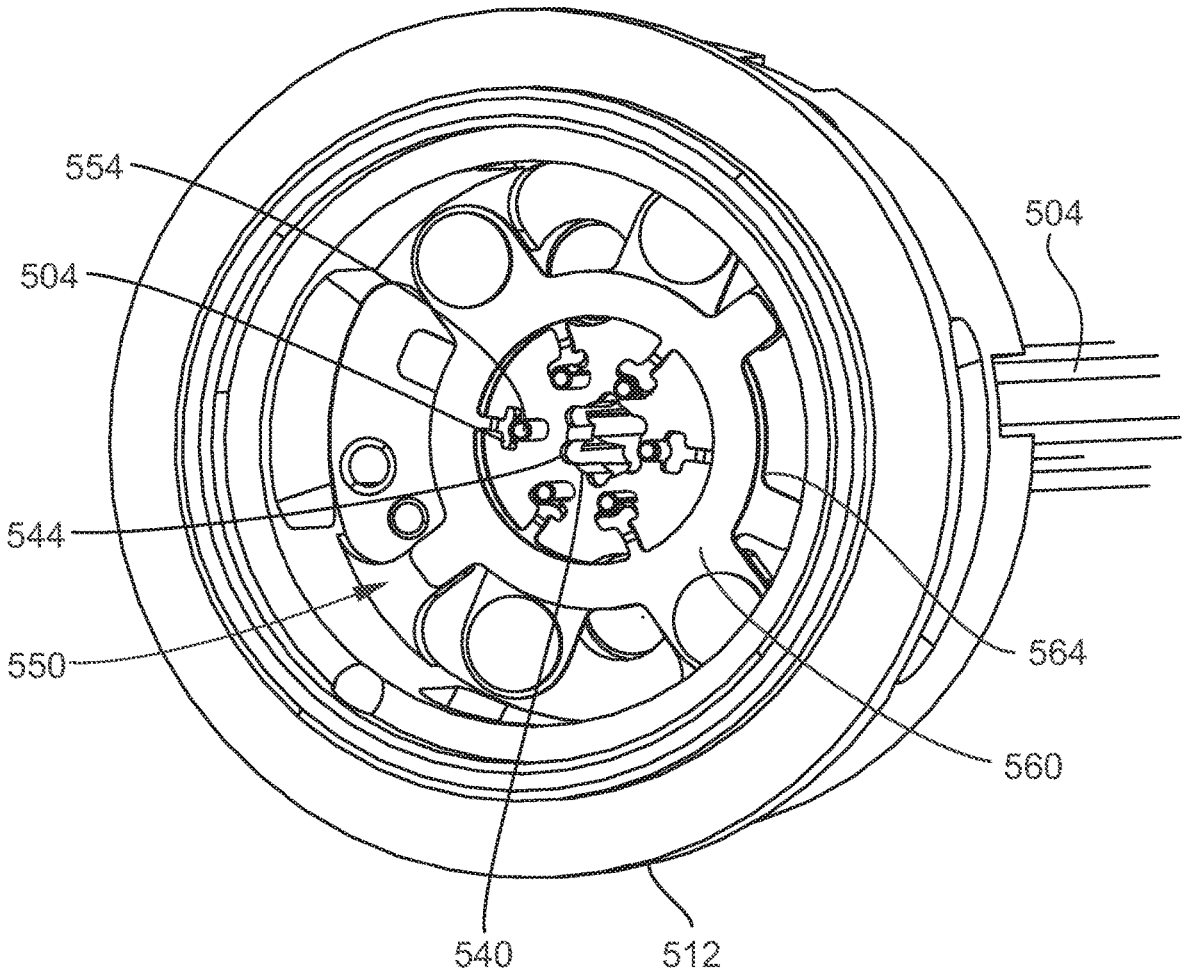
FIG. 5B is a perspective view of the second subassembly illustrated in FIG. 5A, at an end where a second insulator is located.
Figure 5C:
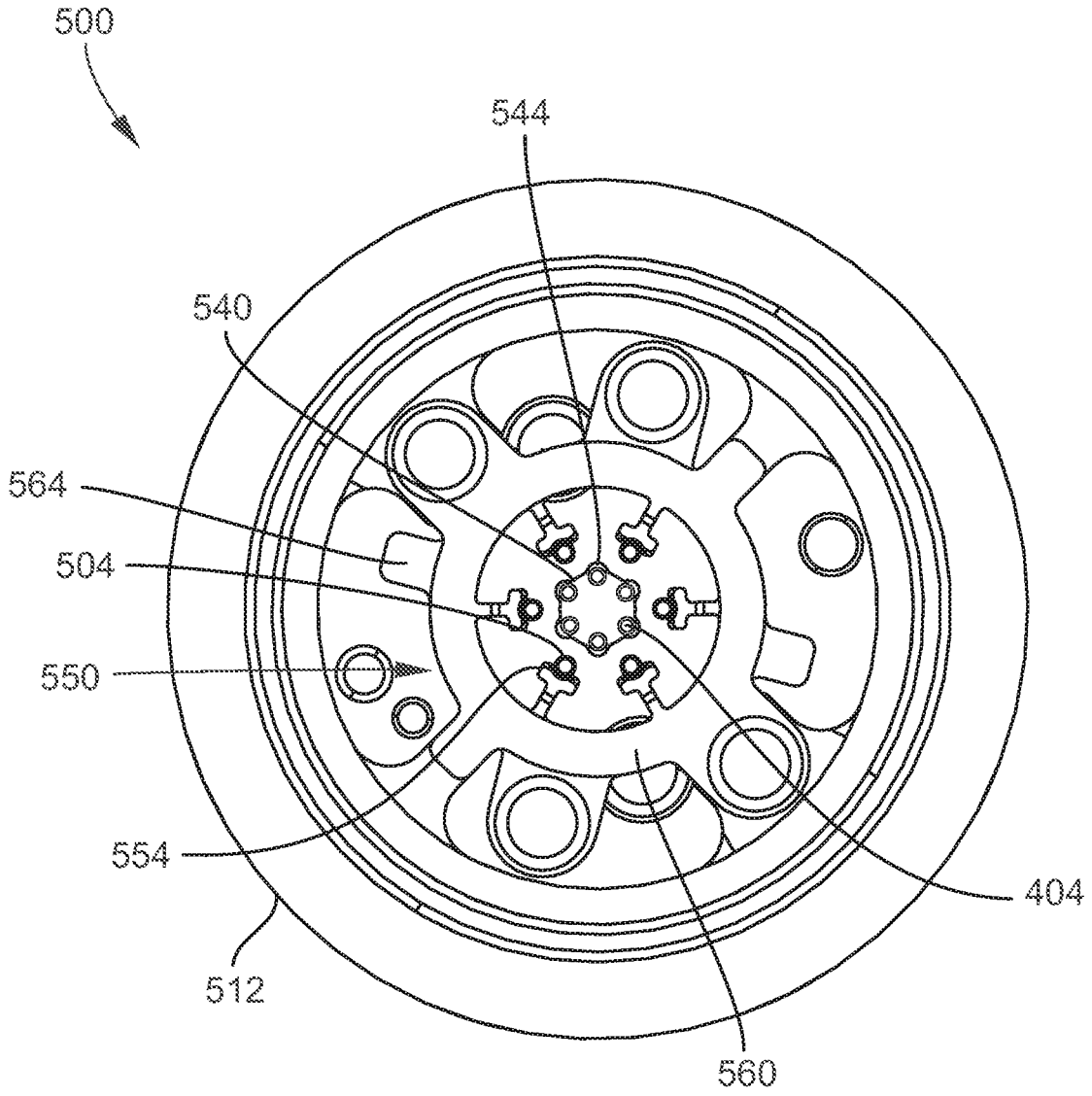
FIG. 5C is a plan view of the second subassembly illustrated in FIG. 5A, at the end where the second insulator is located.

FIG. 5B is a perspective end view of the second subassembly 500. FIG. 5C is a plan end view of the second subassembly 500, and additionally shows the first rods 404 of the first subassembly 400 (described above with reference to FIGS. 4A to 4C) installed in the second subassembly 500. The second insulator 512 includes a second bore wall 540 defining a second bore coaxial with the device axis. The second bore wall 540 includes a plurality of second notches or recesses 544 (e.g., circumferentially) spaced from each other about the device axis. As illustrated in FIG. 5C, during assembly, the first rods 404 are gathered or collapsed and come to rest in the respective second notches 544 in the manner described herein. After assembly, the first rods 404 extend through the second bore at the second rod ends 420 (FIG. 4A) in respective contact with the second notches 544 such that, at the second notches 544, the first rods 404 are positioned at a second radius $R_0$2 from the device axis.

As also shown in FIGS. 5B and 5C, a second electrical contact assembly 550 may be mounted to the outside surface of the second insulator 512. The second contact assembly 550 may be configured in a manner similar to the first contact assembly 448 described above. Accordingly, in the illustrated embodiment, the second contact assembly 550 may be mounted to the outside surface of the second insulator 512. In addition, the second contact assembly 550 includes a plurality of deflectable, electrically conductive second fingers 554 configured to contact the second rods 504 in a spring-biased manner. The second contact assembly 550 may include an electrically conductive first ring 560 from which a first group of the second fingers 554 extend radially inward, and an electrically conductive second ring 564 from which a second group of the second fingers 554 extend radially inward. The first ring 560 and the second ring 564 may be electrically isolated from each other by any suitable means. In the illustrated example, the geometry of the second insulator 512 provides mounting surfaces to space the first ring 560 and the second ring 564 at different axial positions or elevations. As noted above in the case of the first contact assembly 448, this configuration enables different potentials, or potentials with different polarities, to be applied to different second rods 504 as described above, via the respective first ring 560 and second ring 564.

Also similar to the first contact assembly 448, the ends of the second fingers 554 contacting the second rods 504 may be forked. By this configuration, a recess is defined between the two prongs of each second finger 554, and the corresponding second rod 504 is at least partially received in the recess. As noted above in the case of the first contact assembly 448, the forked configuration may be desirable for increasing the area of contact between the first fingers 452 and corresponding first rods 404, thereby increasing electrical contact therebetween.

FIG. 6A is a perspective view of an ion optic assembly 600 containing the first subassembly 400 and the second subassembly 500 illustrated in FIGS. 4A to 5C. FIG. 6B is a cross-sectional view of the ion optic assembly 600. FIGS. 6A and 6B illustrate a state of assembly in which the first rods 404 and second rods 504 have been installed in the first insulator 408 and the second insulator 512 in the manner described above. In addition, a center tube 656 coaxially surrounds the sets of first rods 404 and second rods 504, and is positioned between the first insulator 408 and the second insulator 512. After the first rods 404 and second rods 504 have been installed as described above, the first insulator 408 and the second insulator 512 may be attached to the axial ends of the center tube 656 by any suitable means, such as for example screws or other types of fastening components. The center tube 656 may serve to determine the final longitudinal spacing between the first subassembly 400 and the second subassembly 500. The center tube 656 enables the creation of an enclosed volume that can be used to restrict axial flow (gas conductance), or to create a locally higher pressure for the purposes of collisional fragmentation (e.g., for collision induced dissociation, or CID) or collisional cooling or both. The inside diameter of the center tube 656 may be constant along the device axis between the first insulator 408 and the second insulator 512. Alternatively, as illustrated, the inside diameter of the center tube 656 may vary (be tapered, or frustoconical) along the device axis. In either case, the shape of the enclosed volume of the center tube 656 may be complementary to the outer shape of (or envelope occupied by) the first rods 404 and second rods 504.

From the foregoing, it is seen that by designing the insulators to be their own fixtures, the means of assembly of an ion optic assembly that uses multiple sets of rods can be greatly simplified to a few pressing operations and traditional screws. Hence, expensive, skill dependent and time-consuming processes such as soldering processes, conductive epoxy processes, and the like can be eliminated.

Exemplary Embodiments

Exemplary embodiments provided in accordance with the presently disclosed subject matter include, but are not limited to, the following:

1. An ion optic assembly, comprising: a plurality of electrically conductive rods elongated along a device axis, the rods comprising respective first rod ends and axially opposing second rod ends, wherein the rods are spaced from each other in a transverse plane orthogonal to the device axis; a first insulator comprising a plurality of through-holes, the through-holes spaced from each other about the device axis; and a second insulator comprising a bore wall defining a bore coaxial with the device axis, the bore wall comprising a plurality of notches spaced from each other about the device axis, wherein: the rods respectively extend through the through-holes at the first rod ends; and the rods extend through the bore at the second rod ends in respective contact with the notches.

2. The ion optic assembly of embodiment 1, wherein the plurality of electrically conductive rods is an even number and the even number is at least four.

3. The ion optic assembly of embodiment 1 or 2, wherein: the through-holes are positioned in the transverse plane at a first radius $R_0$1 from the device axis, such that the rods are positioned at the first radius $R_0$1 at the through-holes; and the notches are positioned in the transverse plane such that, at the notches, the rods are positioned at a second radius $R_0$2 from the device axis.

4. The ion optic assembly of embodiment 3, wherein the first radius $R_0$1 and the second radius $R_0$2 are equal.

5. The ion optic assembly of embodiment 3, wherein the first radius $R_0$1 and the second radius $R_0$2 are different.

6. The ion optic assembly of embodiment 1 or 2, wherein the rods are arranged about the device axis L in a circular pattern, an elliptical pattern, or a polygonal pattern.

7. The ion optic assembly of embodiment 1 2, or 6, wherein, in the transverse plane, the spacing between one or more pairs of adjacent rods are different from the spacing between one or more other pairs of adjacent rods.

8. The ion optic assembly of any of the preceding embodiments, wherein the through-holes are oriented at an angle to the device axis such that the rods are spring-based radially outwards against the notches.

9. The ion optic assembly of any of the preceding embodiments, wherein the rods are bowed.

10. The ion optic assembly of any of the preceding embodiments, wherein the through-holes each comprise a slip-fit section having a slip-fit diameter, and a press-fit section adjoining the slip-fit section and having a press-fit diameter, and wherein the press-fit diameter is less than an outer diameter of the rods such that the rods extend through the press-fit sections as a press-fit.

11. The ion optic assembly of any of the preceding embodiments, comprising an electrically conductive contact comprising a plurality of fingers, wherein the fingers are spring-biased radially inward in contact with the respective rods at the first rod ends.

12. The ion optic assembly of embodiment 11, wherein the electrically conductive contact is mounted to the first insulator.

13. The ion optic assembly of embodiment 11 or 12, wherein the plurality of fingers comprises a first group of fingers spring-biased in contact with a first group of the rods, and a second group of fingers spring-biased in contact with a second group of the rods, such that the first group of the rods and the second group of the rods are addressable by separate voltage sources.

14. The ion optic assembly of any of embodiments 11-13, wherein each of the fingers is forked to define a recess, and each corresponding rod is at least partially received in the recess.

15. The ion optic assembly of any of the preceding embodiments, comprising a central tube coaxially surrounding the plurality of electrically conductive rods.

16. The ion optic assembly of embodiment 15, wherein the central tube is close enough to the rods to reduce axial gas conductance.

17. The ion optic assembly of embodiment 15 or 16, wherein the first insulator and the second insulator are attached to opposite ends of the central tube.

18. An ion optic assembly, comprising: a plurality of electrically conductive first rods elongated along a device axis, the first rods comprising respective first rod ends and axially opposing second rod ends, wherein the first rods are spaced from each other in a transverse plane orthogonal to the device axis; a plurality of electrically conductive second rods elongated along the device axis, the second rods comprising respective third rod ends and axially opposing fourth rod ends, wherein the second rods are spaced from each other in the transverse plane; a first insulator comprising a plurality of first through-holes, the first through-holes spaced from each other about the device axis, and a first bore wall defining a first bore coaxial with the device axis and comprising a plurality of first notches spaced from each other about the device axis; and a second insulator comprising a plurality of second through-holes, the second through-holes spaced from each other about the device axis, and a second bore wall defining a second bore coaxial with the device axis, the second bore wall comprising a plurality of second notches spaced from each other about the device axis, wherein: the first rods respectively extend through the first through-holes at the first rod ends; the first rods extend through the second bore at the second rod ends in respective contact with the second notches; the second rods respectively extend through the second through-holes at the third rod ends; and the second rods respectively extend through the second through-holes at the third rod ends; and the second rods extend through the first bore at the fourth rod ends in respective contact with the first notches.

19. The ion optic assembly of embodiment 18, having a configuration selected from the group consisting of: the plurality of first rods is an even number and the even number is at least four; the plurality of second rods is an even number and the even number is at least four; and both of the foregoing.

20. The ion optic assembly of embodiment 18 or 19, having a configuration selected from the group consisting of: the first rods are arranged about the device axis L in a circular pattern, an elliptical pattern, or a polygonal pattern; the second rods are arranged about the device axis L in a circular pattern, an elliptical pattern, or a polygonal pattern; and both of the foregoing.

21. The ion optic assembly of any of embodiments 1 or 2, having a configuration selected from the group consisting of: in the transverse plane, the spacing between one or more pairs of adjacent first rods are different from the spacing between one or more other pairs of adjacent first rods; in the transverse plane, the spacing between one or more pairs of adjacent first rods are different from the spacing between one or more other pairs of adjacent first rods; in the transverse plane, the spacing between one or more pairs of adjacent second rods are different from the spacing between one or more other pairs of adjacent second rods; and both of the foregoing.

22. The ion optic assembly of any of embodiments 18-21, wherein: the first through-holes are positioned in the transverse plane at a first radius $R_0$1 from the device axis, such that the first rods are positioned at the first radius $R_0$1 at the first through-holes; the second notches are positioned in the transverse plane such that, at the second notches, the first rods are positioned at a second radius $R_0$2 from the device axis; the second through-holes are positioned in the transverse plane at a third radius $R_0$3 from the device axis, such that the second rods are positioned at the third radius $R_0$3 at the second through-holes; and the first notches are positioned in the transverse plane such that, at the first notches, the second rods are positioned at a fourth radius $R_0$4.

23. The ion optic assembly of embodiment 22, wherein the first radius $R_0$1 and the second radius $R_0$2 are equal.

24. The ion optic assembly of embodiment 22, wherein the first radius $R_0$1 and the second radius $R_0$2 are different.

25. The ion optic assembly of any of embodiments 22-24, wherein the third radius $R_0$3 and the radius $R_0$4 are equal.

26. The ion optic assembly of any of embodiments 22-24, wherein the third radius $R_0$3 and the radius $R_0$4 are different.

27. The ion optic assembly of any of embodiments 18-26, having a configuration selected from the group consisting of: the first through-holes surround the first notches in the transverse plane; the second through-holes surround the second notches in the transverse plane; and both of the foregoing.

28. The ion optic assembly of any of embodiments 18-27, having a configuration selected from the group consisting of: the first through-holes are oriented at an angle to the device axis such that the first rods are spring-based radially outwards against the second notches; the second through-holes are oriented at an angle to the device axis such that the second rods are spring-based radially outwards against the first notches; and both of the foregoing.

29. The ion optic assembly of any of embodiments 18-28, wherein the first rods are bowed, or the second rods are bowed, or the first rods and the second rods both are bowed. The ion optic assembly of any of embodiments 18-28, wherein the first rods are bowed, or the second rods are bowed, or the first rods and the second rods both are bowed.

30. The ion optic assembly of any of embodiments 18-29, having a configuration selected from the group consisting of: the first through-holes each comprise a slip-fit section having a slip-fit diameter, and a press-fit section adjoining the slip-fit section and having a press-fit diameter, and wherein the press-fit diameter is less than an outer diameter of the first rods such that the first rods extend through the press-fit sections as a press-fit; the second through-holes each comprise a slip-fit section having a slip-fit diameter, and a press-fit section adjoining the slip-fit section and having a press-fit diameter, and wherein the press-fit diameter is less than an outer diameter of the second rods such that the second rods extend through the press-fit sections as a press-fit; and both of the foregoing.

31. The ion optic assembly of any of embodiments 18-30, comprising an electrically conductive first contact comprising a plurality of first fingers, wherein the first fingers are spring-biased radially inward in contact with the respective first rods at the first rod ends.

32. The ion optic assembly of embodiment 31, wherein the first contact is mounted to the first insulator.

33. The ion optic assembly of embodiment 31 or 32, wherein the plurality of first fingers comprises a first group of first fingers spring-biased in contact with a first group of the first rods, and a second group of first fingers spring-biased in contact with a second group of the first rods, such that the first group of the first rods and the second group of the first rods are addressable by separate voltage sources.

34. The ion optic assembly of any of embodiments 31-33, wherein each of the first fingers is forked to define a recess, and each corresponding first rod is at least partially received in the recess.

35. The ion optic assembly of any of embodiments 18-34, comprising an electrically conductive second contact comprising a plurality of second fingers, wherein the second fingers are spring-biased radially inward in contact with the respective second rods at the third rod ends.

36. The ion optic assembly of embodiment 35, wherein the second contact is mounted to the second insulator.

37. The ion optic assembly of embodiment 35 or 36, wherein the plurality of second fingers comprises a first group of second fingers spring-biased in contact with a first group of the second rods, and a second group of second fingers spring-biased in contact with a second group of the second rods, such that the first group of the second rods and the second group of the second rods are addressable by separate voltage sources.

38. The ion optic assembly of any of embodiments 35-37, wherein each of the second fingers is forked to define a recess, and each corresponding second rod is at least partially received in the recess.

39. The ion optic assembly of any of embodiments 18-38, comprising a central tube coaxially surrounding the first rods and the second rods.

40. The ion optic assembly of embodiment 39, wherein the central tube is close enough to the first rods and the second rods to reduce axial gas conductance.

41. The ion optic assembly of embodiment 39 or 40, wherein the first insulator and the second insulator are attached to opposite ends of the central tube.

42. A method for assembling an ion optic assembly, the method comprising: providing a first insulator positioned on a device axis and comprising a plurality of through-holes, wherein the through-holes are spaced from each other in a transverse plane orthogonal to the device axis; providing a plurality of electrically conductive rods comprising respective first rod ends and axially opposing second rod ends;

inserting the rods at the first rod ends into the respective through-holes, such that the rods are elongated along the device axis; positioning a second insulator to face the first insulator along the device axis, the second insulator comprising a bore wall defining a bore coaxial with the device axis, the bore wall comprising a plurality of notches spaced from each other about the device axis; and inserting the rods at the second rod ends into the bore such that the rods respectively contact the notches.

43. The method of any of embodiments 42, wherein inserting the rods into the through-holes comprises inserting the rods simultaneously in a single press operation.

44. The method of embodiment 42 or 43, comprising inserting the second rod ends into the bore such that the rods collapse toward each other and subsequently spring outward into contact with the respective notches.

45. The method of any of embodiments 42-44, wherein the through-holes are oriented at an angle to the device axis such that the rods are spring-based radially outwards against the notches.

46. The method of any of embodiments 42-45, wherein, prior to or after inserting the rods into the bore, the rods diverge away from each other in an axial direction away from the first insulator.

47. The method of any of embodiments 42-45, wherein, prior to or after inserting the rods into the bore, the rods converge toward each other in an axial direction away from the first insulator.

48. The method of any of embodiments 42-47, comprising, before or after inserting the rods into the through-holes, mounting an electrically conductive contact comprising a plurality of fingers, such that the fingers are spring-biased radially inward in contact with the respective rods at the first rod ends.

49. The method of any of embodiments 42-48, comprising surrounding the plurality of electrically conductive rods with a central tube between the first insulator and the second insulator.

50. The method of embodiment 49, comprising attaching the first insulator and the second insulator to opposing axial ends of the central tube.

51. A method for assembling an ion optic assembly, the method comprising: providing a first insulator comprising a plurality of first through-holes, the first through-holes spaced from each other about a device axis, and a first bore wall defining a first bore coaxial with the device axis and comprising a plurality of first notches spaced from each other about the device axis; providing a second insulator comprising a plurality of second through-holes, the second through-holes spaced from each other about the device axis, and a second bore wall defining a second bore coaxial with the device axis, the second bore wall comprising a plurality of second notches spaced from each other about the device axis; providing a plurality of electrically conductive first rods comprising respective first rod ends and axially opposing second rod ends; providing a plurality of electrically conductive second rods comprising respective third rod ends and axially opposing fourth rod ends; inserting the first rods into the respective first through-holes at the first rod ends; inserting the second rods into the respective second through-holes at the third rod ends; inserting the first rods into the second bore of the second insulator at the second rod ends, such that the first rods contact the respective second notches; and inserting the second rods into the first bore of the first insulator at the fourth rod ends, such that the second rods contact the respective first notches.

52. The method of embodiment 51, having a feature selected from the group consisting of: inserting the first rods into the first through-holes comprises inserting the first rods simultaneously in a single press operation; inserting the second rods into the through-holes comprises inserting the second rods simultaneously in a single press operation; and both of the foregoing.

53. The method of embodiment 51 or 52, comprising a feature selected from the group consisting of: inserting the first rods into the second bore of the second insulator such that the second rod ends collapse toward each other and subsequently spring outward into contact with the respective second notches; inserting the first rods into the second bore of the second insulator such that the second rod ends collapse toward each other and subsequently spring outward into contact with the respective second notches, wherein the first through-holes are oriented at an angle to the device axis such that the first rods are spring-based radially outwards against the second notches; inserting the second rods into the first bore of the first insulator such that the fourth rod ends collapse toward each other and subsequently spring outward into contact with the respective first notches; inserting the second rods into the first bore of the first insulator such that the fourth rod ends collapse toward each other and subsequently spring outward into contact with the respective first notches, wherein the second through-holes are oriented at an angle to the device axis such that the second rods are spring-based radially outwards against the first notches; and a combination of two or more of the foregoing.

54. The method of any of embodiments 51-53, comprising a step selected from the group consisting of: before or after inserting the first rods into the first through-holes, mounting an electrically conductive first contact comprising a plurality of first fingers, such that the first fingers are spring-biased radially inward in contact with the respective first rods; before or after inserting the second rods into the second through-holes, mounting an electrically conductive contact comprising a plurality of second fingers, such that the second fingers are spring-biased radially inward in contact with the respective second rods; and both of the foregoing.

55. The method of any of embodiments 51-54, comprising surrounding the first rods and the second rods with a central tube between the first insulator and the second insulator.

56. The method of embodiment 66, comprising attaching the first insulator and the second insulator to opposing axial ends of the central tube.

It will be understood that terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion optic assembly, comprising:

a plurality of electrically conductive rods elongated along a device axis, the rods comprising respective first rod ends and axially opposing second rod ends, wherein the rods are spaced from each other in a transverse plane orthogonal to the device axis;

a first insulator comprising a plurality of through-holes, the through-holes spaced from each other about the device axis; and a second insulator comprising a bore wall defining a bore coaxial with the device axis, the bore wall comprising a plurality of notches spaced from each other about the device axis, wherein:

the rods respectively extend through the through-holes at the first rod ends; and the rods extend through the bore at the second rod ends in respective contact with the notches.

2. The ion optic assembly of claim 1, wherein:

the through-holes are positioned in the transverse plane at a first radius $R_0$1 from the device axis, such that the rods are positioned at the first radius $R_0$1 at the through-holes; and the notches are positioned in the transverse plane such that, at the notches, the rods are positioned at a second radius $R_0$2 from the device axis.

3. The ion optic assembly of claim 1, wherein the through-holes are oriented at an angle to the device axis such that the rods are spring-based radially outwards against the notches.

4. The ion optic assembly of claim 1, wherein the rods are bowed.

5. The ion optic assembly of claim 1, wherein the through-holes each comprise a slip-fit section having a slip-fit diameter, and a press-fit section adjoining the slip-fit section and having a press-fit diameter, and wherein the press-fit diameter is less than an outer diameter of the rods such that the rods extend through the press-fit sections as a press-fit.

6. The ion optic assembly of claim 1, comprising an electrically conductive contact comprising a plurality of fingers, wherein the fingers are spring-biased radially inward in contact with the respective rods at the first rod ends.

7. The ion optic assembly of claim 1, comprising a central tube coaxially surrounding the plurality of electrically conductive rods.

8. An ion optic assembly, comprising:

a plurality of electrically conductive first rods elongated along a device axis, the first rods comprising respective first rod ends and axially opposing second rod ends, wherein the first rods are spaced from each other in a transverse plane orthogonal to the device axis;

a plurality of electrically conductive second rods elongated along the device axis, the second rods comprising respective third rod ends and axially opposing fourth rod ends, wherein the second rods are spaced from each other in the transverse plane;

a first insulator comprising a plurality of first through-holes, the first through-holes spaced from each other about the device axis, and a first bore wall defining a first bore coaxial with the device axis and comprising a plurality of first notches spaced from each other about the device axis; and a second insulator comprising a plurality of second through-holes, the second through-holes spaced from each other about the device axis, and a second bore wall defining a second bore coaxial with the device axis, the second bore wall comprising a plurality of second notches spaced from each other about the device axis, wherein:

the first rods respectively extend through the first through-holes at the first rod ends;

the first rods extend through the second bore at the second rod ends in respective contact with the second notches;

the second rods respectively extend through the second through-holes at the third rod ends; and the second rods extend through the first bore at the fourth rod ends in respective contact with the first notches.

9. The ion optic assembly of claim 8, wherein:

the first through-holes are positioned in the transverse plane at a first radius $R_0$1 from the device axis, such that the first rods are positioned at the first radius $R_0$1 at the first through-holes;

the second notches are positioned in the transverse plane such that, at the second notches, the first rods are positioned at a second radius $R_0$2 from the device axis;

the second through-holes are positioned in the transverse plane at a third radius $R_0$3 from the device axis, such that the second rods are positioned at the third radius $R_0$3 at the second through-holes; and the first notches are positioned in the transverse plane such that, at the first notches, the second rods are positioned at a fourth radius $R_0$4.

10. The ion optic assembly of claim 8, having a configuration selected from the group consisting of:

the first through-holes surround the first notches in the transverse plane;

the second through-holes surround the second notches in the transverse plane; and both of the foregoing.

11. The ion optic assembly of claim 8, having a configuration selected from the group consisting of:

the first through-holes are oriented at an angle to the device axis such that the first rods are spring-based radially outwards against the second notches;

the second through-holes are oriented at an angle to the device axis such that the second rods are spring-based radially outwards against the first notches; and both of the foregoing.

12. The ion optic assembly of claim 8, wherein the first rods are bowed, or the second rods are bowed, or the first rods and the second rods both are bowed.

13. The ion optic assembly of claim 8, having a configuration selected from the group consisting of:

the first through-holes each comprise a slip-fit section having a slip-fit diameter, and a press-fit section adjoining the slip-fit section and having a press-fit diameter, and wherein the press-fit diameter is less than an outer diameter of the first rods such that the first rods extend through the press-fit sections as a press-fit;

the second through-holes each comprise a slip-fit section having a slip-fit diameter, and a press-fit section adjoining the slip-fit section and having a press-fit diameter, and wherein the press-fit diameter is less than an outer diameter of the second rods such that the second rods extend through the press-fit sections as a press-fit; and both of the foregoing.

14. The ion optic assembly of claim 8, comprising a feature selected from the group consisting of:

an electrically conductive first contact comprising a plurality of first fingers, wherein the first fingers are spring-biased radially inward in contact with the respective first rods at the first rod ends;

an electrically conductive second contact comprising a plurality of second fingers, wherein the second fingers are spring-biased radially inward in contact with the respective second rods at the third rod ends; and both of the foregoing.

15. A method for assembling an ion optic assembly, the method comprising:

providing a first insulator positioned on a device axis and comprising a plurality of through-holes, wherein the through-holes are spaced from each other in a transverse plane orthogonal to the device axis;

providing a plurality of electrically conductive rods comprising respective first rod ends and axially opposing second rod ends;

inserting the rods at the first rod ends into the respective through-holes, such that the rods are elongated along the device axis;

positioning a second insulator to face the first insulator along the device axis, the second insulator comprising a bore wall defining a bore coaxial with the device axis, the bore wall comprising a plurality of notches spaced from each other about the device axis; and inserting the rods at the second rod ends into the bore such that the rods respectively contact the notches.

16. The method of claim 15, wherein inserting the rods into the through-holes comprises inserting the rods simultaneously in a single press operation.

17. The method of claim 15, comprising inserting the rods into the bore such that the rods collapse toward each other and subsequently spring outward into contact with the respective notches.

18. The method of claim 15, comprising a feature selected from the group consisting of:

prior to inserting the rod into the bore, the rods diverge away from each other in an axial direction away from the first insulator;

after inserting the rods into the bore, the rods diverge away from each other in an axial direction away from the first insulator;

prior to inserting the rods into the bore, the rods converge toward each other in an axial direction away from the first insulator;

after inserting the rods into the bore, the rods converge toward each other in an axial direction away from the first insulator; and a combination of two or more of the foregoing.

19. The method of claim 15, comprising, before or after inserting the rods into the through-holes, mounting an electrically conductive contact comprising a plurality of fingers, such that the fingers are spring-biased radially inward in contact with the respective rods at the first rod ends.

20. The method of claim 15, comprising surrounding the plurality of electrically conductive rods with a central tube between the first insulator and the second insulator.

* * * * *